US008093969B2

(12) United States Patent
Liu et al.

(10) Patent No.: US 8,093,969 B2
(45) Date of Patent: Jan. 10, 2012

(54) LOW-POWER NUMERICALLY CONTROLLED CONTACTOR AND CONTROL SYSTEM MADE OF THE CONTACTORS

(76) Inventors: Jinping Liu, Chengdu (CN); Ronggao Chen, Chengdu (CN)

( * ) Notice: Subject to any disclaimer, the term of this patent is extended or adjusted under 35 U.S.C. 154(b) by 722 days.

(21) Appl. No.: 12/066,235

(22) PCT Filed: Aug. 28, 2006

(86) PCT No.: PCT/CN2006/002210

§ 371 (c)(1),
(2), (4) Date: Mar. 7, 2008

(87) PCT Pub. No.: WO2007/028321

PCT Pub. Date: Mar. 15, 2007

(65) Prior Publication Data

US 2008/0238594 A1 Oct. 2, 2008

(30) Foreign Application Priority Data

Sep. 9, 2005 (CN) ..... 2005 1 0021642

(51) Int. Cl.
*H01H 51/22* (2006.01)

(52) U.S. Cl. ..... 335/78; 335/128

(58) Field of Classification Search ..... 335/78, 335/128–132

See application file for complete search history.

(56) References Cited

U.S. PATENT DOCUMENTS

| | | | | |
|---|---|---|---|---|
| 4,506,243 | A * | 3/1985 | Okado et al. | 335/132 |
| 4,779,582 | A * | 10/1988 | Lequesne | 123/90.11 |
| 7,156,057 | B2 * | 1/2007 | Lecrivain et al. | 123/90.11 |
| 2005/0041370 | A1 * | 2/2005 | Wilk et al. | 361/502 |
| 2005/0052265 | A1 * | 3/2005 | Vladimirescu et al. | 335/229 |
| 2005/0274335 | A1 * | 12/2005 | Lecrivain et al. | 123/90.11 |

FOREIGN PATENT DOCUMENTS

| | | |
|---|---|---|
| CN | 86205252 | 8/1987 |
| CN | 87207644 | 12/1987 |
| CN | 2197741 | 5/1995 |
| CN | 1622243 | 6/2005 |
| CN | 1707718 | 12/2005 |
| CN | 1725411 | 1/2006 |
| CN | 1755860 | 4/2006 |
| CN | 2789921 | 6/2006 |

OTHER PUBLICATIONS

International Search Report for corresponding PCT Application, PCT/CN2006/002210, dated Dec. 28, 2006.

* cited by examiner

*Primary Examiner* — Bernard Rojas
(74) *Attorney, Agent, or Firm* — Caesar, Rivise, Bernstein, Cohen & Pokotilow, Ltd.

(57) ABSTRACT

The invention deals with a kind of switchboards, especially involving contactors, cores and driving circuits. The invention has solved three problems of high driving power, high consumption and short service life in current contactors, and has provided a LCDC contactor inlaid with driving circuit and controlling port. LCDC contactor in this invention consists of field coils, movable and fixed cores. The fixed core is folded with silicon-steel sheets, and the permanent magnet laid in the fixed core. LCDC contactor includes driving circuit inside, the field coils are connected with driving circuit and the circuit connecting external power is used to control signal of driving coils. This invention provides a controlling system constituted of the LCDC contactors. Low power consumption, effortless driving, long service life are the main beneficial effects. The LCDC contactor can directly employ nominal voltage DC 24V switching power with a remarkably energy-saving effect.

8 Claims, 4 Drawing Sheets

LOW-POWER NUMERICALLY CONTROLLED CONTACTOR AND CONTROL SYSTEM MADE OF THE CONTACTORS

TECHNICAL AREA

This invention is concerned about a kind of switchgears, especially involving contactors, cores and driving circuits.

TECHNOLOGICAL BACKGROUND

AC contactor has been widely used in both automation in industrial processing control and Low Voltage terminal power supplies since it appeared, therefore, a solid market basis has existed for a long time. The process of picking-up, holding and breaking in AC contactor is complex and dynamic. The main disadvantages of the current AC contactor are as follows: unsatisfied dynamic control, high driving power, large energy consumption resulting in frequent burned-outs of coils and short service life. Although driving devices designed for new intelligent contactors improve its performance with advanced electric circuit and control chip used for real-time controlling in the whole dynamic process, problems including high complexity of driving circuit and large start-up power still exist. Controlling system mainly consisted of by AC contractors does feature in simply control circuit, strong driving force and low cost, but its application and development has been hampered due to the needs to amplify power through intermediate devices and to set up control circuit for lowering pick-up power when PLC drives large AC contactors.

SUMMARY OF INVENTION

The technical problems this invention is supposed to solve have been done through a inventional structure of cores adapted for 100 A-800 A large-scale AC contactor. This invention provides a LCDC (Low Consumption Digital Controlled) contactor using an inventional structure of cores and the controlling system formed The LCDC contractor consists of field coils, movable and fixed cores. The fixed core is folded with silicon-steel sheets; and features permanent magnet laid in the core. The permanent magnet is inlaid in the position furthest from the movable core.

The fixed core is E type with permanent magnets inlaid at the bottom of each flute;

The fixed core is U type with permanent magnet inlaid at the bottom of the flute.

The permanent magnet is Nd—Fe—B permanent magnet.

The LCDC contactor includes driving circuit inside; field coils are connected with driving circuit; the circuit connecting external power is used to control signals of driving coils.

The driving circuit connects external power source and controlling signal through 3 terminals which are power port, controlling port and public port.

The field coils are driven by driving circuit in a way of single-pulse

The driving circuit is consisted of relay, capacitor and circuit of charging and discharging.

This controlling system invented includes power source, controller and at least one LCDC contactor; the power mentioned is connected with LCDC contactor and controller; the LCDC contactor connects the controller.

The power above-mentioned is switching power; the mentioned controller is PLC or PLD.

Low power consumption, effortless driving, long service life are the main beneficial effects. The LCDC contactor can directly employ nominal voltage DC 24V switching power (V=18~24V, I=0.4~1 A, 10 W) and the power ranges from AC85V to 264V with a remarkably energy-saving effect. Switching power is able to power LPC CNC at a long distance (500 m) featuring in flexible wire connections and safe operations. The control ports of the driving circuit can be directly driven by IC, SCM, PLD, LOGO, PLC, etc. Conquering the inherent disadvantages of AC contactor, this invention integrates electricity and electronics perfectly in the controlling system.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS

Figure 1:
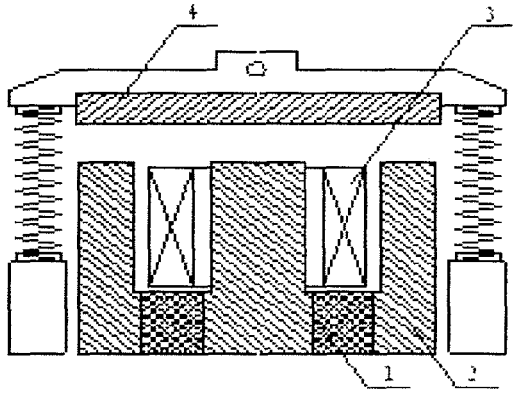
FIG. 1: Operation of Example 1

Technical plan in this invention will be explained hereafter in details with illustrations and examples.

LCDC contactor in this invention adopts cores folded with silicon-steel sheets and fixed core inlaid with permanent magnet in order to increase fixed cores' picking-up strength against movable cores while decreasing the demand for magnetic force from the field coils and driving currents needed by the field coils, and therefore requires lower driving power. After LCDC contactor picks up, it will maintain status of contacting without supporting current due to forces from permanent magnets. As a result, LCDC contactor reduces power consumption further.

The built-in driving circuit used in the LCDC contactor exploits a variety of power-saving measures and stability improving methods. Because the structure of the circuit is designed novelly the whole driving circuit is installed within the base of the LCDC contactor. Integrated with LCDC contactor, the driving circuit connects external power through 3-port connector so as to drive the field coils. Driving current provided for field coils in LCDC contactor adopts single-pulse driving by which the pulse-current is kept no more than 50 ms whenever breaking or pick-up.

New characteristics have been added into the process of pick-up, holding and breaking as there is permanent magnet in fixed core which actually acts as one more magnetic source.

Pick-up: The permanent magnet inlaid increases the attraction from fixed core to movable core. Adopting single-pulse trigger current excitation and storage capacitor driving circuit reduces the starting power of LCDC contactor significantly. The pick-up of main contactor is accomplished by the compound magnetic force of electromagnetism and permanent magnet force which eliminates the vibration of contact.

Holding: The holding process can be divided into Pick-up Holding and Breaking Holding. When it's at Pick-up Holding stage where there is no supporting current in the field coils, stable picking up status will be kept by magnetic forces, therefore, force of permanent magnets should be as strong as possible; when at Breaking Holding stage, in order to avoid mispick-up movements it is demanded that the magnetic force be as weak as possible. It proves that after be magnetized permanent magnet has not only residual magnetic force but also trait to produce inductive magnetic force when magnetized by outer magnetic field. As a result, the magnetic capability of the permanent magnet will be influenced repeatedly by field coil's magnetic field at both stages of pick-up and breaking. On the one hand, the magnetic field produced by current in field coils at pick-up has the same direction as the one of permanent magnet, which is actually a process of charging that will increase the magnetic force of the permanent magnet. When the current disappears, the magnet still owns comparatively strong force to keep movable core at pick-up stage. On the other hand, the magnetic field appears when breaking is a process of discharging for the permanent magnet. Demagnetization causes magnet's force to be changed within the range of recoil curve. The alternation of magnetic charging and discharging does not change magnetic stability of the permanent magnet; meanwhile, it realizes the expectation to make the permanent magnet keep comparatively strong magnetic strength when pick up and comparatively weak strength when breaking.

Breaking: as permanent magnet has been inlaid, reverse current is needed to overcome magnet's force to movable core. Thanks to driving way of single-pulse trigger current, easy controllability of contactor's breaking timing can be seen.

Nd—Fe—B permanent magnet is the key component of the permanent magnetic part, the magnetism of which will be affected by many factors including environment, temperature, time, etc. Therefore, advanced manufacturing, processing and assembling techniques have been set up at the basis of complete exploration for guaranteeing permanent magnetic part to be working well in terms of time and stability.

The technical measure to realize starting with low power through LCDC contactor is as follows: to finish charging storage capacitor within pre-set time and to provide energy needed for start-up from the capacitor. The action frequency of the LCDC contactor are 600 times/hr, 1200 times/hr, 2400 times/hr with the charging current to be 300 mA, 400 mA, 500 mA. When power voltage is DC 24V, the correspondent start-up power consumptions are 7.2 W, 9.6 W, 12 W and power consumption at pick-up is 0.12 W (caused by built-in driving circuit electricity usage), which is great improvement compared with 162 W start-up and 9.8 W pick-up power consumptions by existing intelligent contactors. This is to say, power consumption of LCDC contactor is comparative with ordinary transistor making it completely compatible to low-voltage electric circuit and providing a practical choice of automation engineering design.

Measures to realize minor temperature rise of LCDC contactor: since cores, field coils and driving circuit are all sealed in the base of LCDC contactor, and the performance of Nd—Fe—B permanent magnet and ELectrolytic Capacitor is easily affected by temperature, it is crucial to carry out temperature controlling. The heat-producing components in LCDC contactor includes cores (collision of fixed and movable cores at pick-up and breaking), field coils and current limiter in driving circuit. Under the control of above-mentioned factors and at the environment temperature of 30 degree Celsius, LCDC contactor will be working consistently at the operation frequency of 2400 ops/h with measured temperature rise of no more than 6 degree Celsius.

EXAMPLE 1

Figure 2:
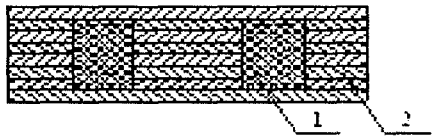
FIG. 2: Horizontal sectional view of Fixed Core in FIG. 1
FIG. 3: Operation of Example 2

FIG. 1 is a kind of EI type core structure. 1 is permanent magnet; 2 is fixed core; 3 is field coils and 4 is movable core. Fixed core 2 is E type and movable core 4 is I type. Here the core in LCDC contactor is folded with silicon-steel as indicated in FIG. 2. Permanent magnet 1 is Nd—Fe—B permanent magnet and double permanent magnets structure is adopted in this example. Permanent magnet 1 is laid in the middle of the flute of E type fixed core 2 as it is easy for manufacturing and installing permanent magnet 1 in this position, and less reduction of mechanical strength of fixed core is made during processing fixed core and fixing magnet in it. When LCDC contactor is at breaking position, magnetic reluctance of each branch from permanent magnet to core joint is close which balances the magnetic field distribution at each joint. Because the permanent magnet is far from the movable core, so the suction strength to movable core is comparatively weak. Though the movable core disturbed by the external force, it is guaranteed to be no malfunction. LCDC contactor keeps pick-up position by low-magnetic circuit. It is significant that the position installed still meet requirement even the magnetic force varies over a wide range. EI type core is the best choice of LCDC contactor because it matches the DC driving circuit very well.

EXAMPLE 2

Figure 3:
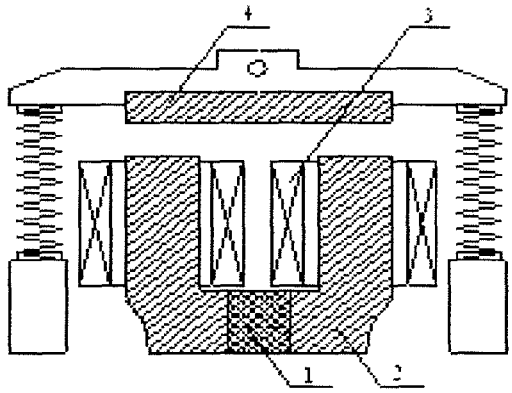
Figure 4:
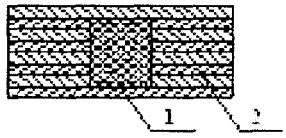
FIG. 4: Horizontal sectional view of Fixed Core in FIG. 3
FIG. 5: Circuit Principle Map of Operation of Example 3

As indicated in FIG. 3, the cores used in this example is UI shape among which fixed core 2 is U type and movable core 4 is type of I. Permanent magnet 1 is laid in the middle position of flute's bottom in U-Shape fixed core 2. FIG. 4 is the horizontal sectional view of Fixed Core employed in Example 2. Dual field coils will be found in this kind of LCDC contactor. The cores of UI type are suitable for big 300-800 A LCDC contactor. In order to simplify the designing of magnetic circuit, in this example only single permanent magnet is put into use. Either parallel driving or synchronized driving of double field coils is an effective solution for start-up difficulties big contactors are facing when adopting standard DC 24V and remarkably demonstrates its structural advantage. The other parts of structure in this example are the same as those in Example 1.

EXAMPLE 3

Figure 5:
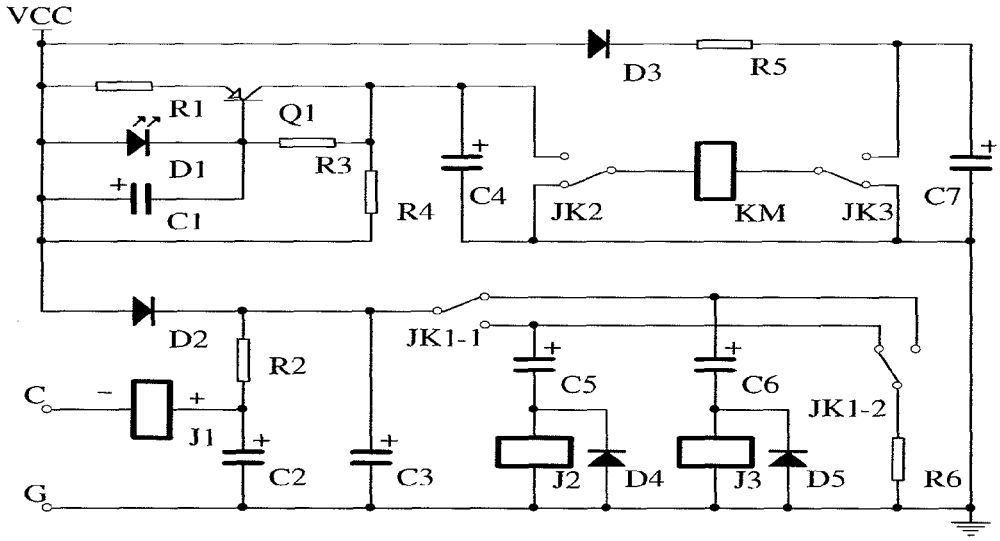

FIG. 5 is the principle of the driving circuit. The driving circuit is installed in the base of the LCDC contactor as a whole. In the FIG. 5, field coils KM are connected with power source by switch JK2 and JK3 which act as contacts of relay J2 and relay J3. The actions of charging and discharging in capacitor C5 and C6 connected in series with relay J2 and relay J3 are controlled by switch JK1-1, JK1-2. The switch JK1-1, JK1-2 are operated through relay J1 which is controlled by external controlling signal. As indicated in FIG. 5, C is connected with external controlling signal, Vcc is connected with the positive power source, and G is common ground.

As illustrated in FIG. 5, the three independent power branching circuits in power circuit take charge in power supplying for picking-up circuit, breaking circuit and controlling circuit respectively. The circuit of constant flow source consisted of external power, resistor R1, light-emitting diode D1, capacitor C1, triode Q1, resistor R3, resistor R4 charges the storage capacitor C4, which consistitues a pick-up power source; External power, diode D3, resistor R5 consistite breaking circuit charging the capacitor C7; External power and diode D2 constitute controlling power source charging the capacitor C3.

The constant flow source constituted of resistor R1, resistor R3, triode Q1, diode D1 controls the charging of capacitor C4. The value of constant current is decided by the resistro R1. Capacitor C1 in the figure is used to delay the opening of triode Q1. Resistor R4 in the figure is used to charge the capacitor C4 to achieve the power voltage. At the end of the process of charging, the triode Q1 is closed to reduce its own energy consumption. When LCDC contactor powers off, storage capacitor C4 charges the external power through the resistor R4.

Figure 6:
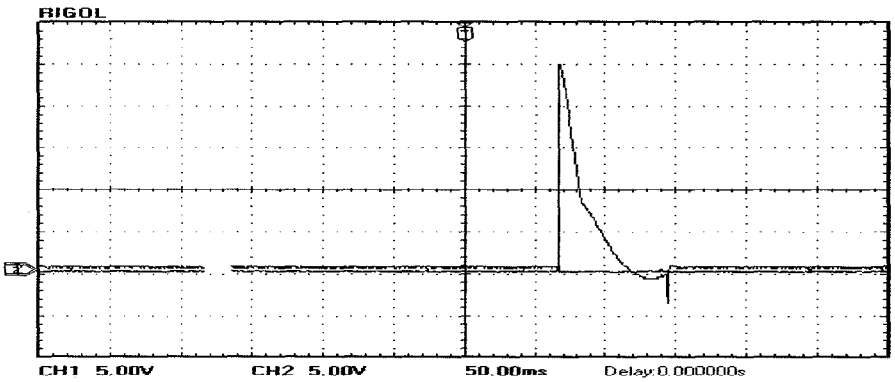
FIG. 6: Voltage oscillograph of Field Coils in Pick-Up

The field coils KM in FIG. 5 control LCDC contactor to pick-up, hold and break in the way of changing the current directions of KM by switch JK2 and JK3. The working process of circuit is: As the power is on, the field coil KM is connected to the ground by the normally closed points of switch JK2 and JK3, which enables LCDC contactor in a state of readiness. As the controlled port C is "0", relay J1 picks up, capacitor C5 charges the relay J2 to pick up, field coils KM power up by the regular open point of switch JK2, and capacitor C4 charges the LCDC contactor to pick up. Capacitor C5, relay J2 constitute LC circuit. After time-delaying, relay J2 releases, field coil KM powers off by the regular close point of JK2, while LCDC contactor keeps at holding position by permanent magnetic attraction. From the voltage oscillograph of field coils KM shown in FIG. 6, it is seen that the current is a single-pulse(ignore the vibrating voltage in field coil), and the duration is less than 50 ms. The circuit consisted of normally opening point of JK1-2, resistor R6, and diode D5 discharges the capacitor C6.

As the controlled port C is "1", relay J1 releases, capacitor C6 charges the relay J3 to pick up, the field coils KM power up reversely by the normally opened point of switch JK3, and capacitor C7 charges LDCD contactor to break.

Capacitor C6, relay J3 constitute LC circuit. After time-delaying, relay J3 releases, field coil KM power off, and LCDC contactor on breaking position by spring supporting.

Figure 7:
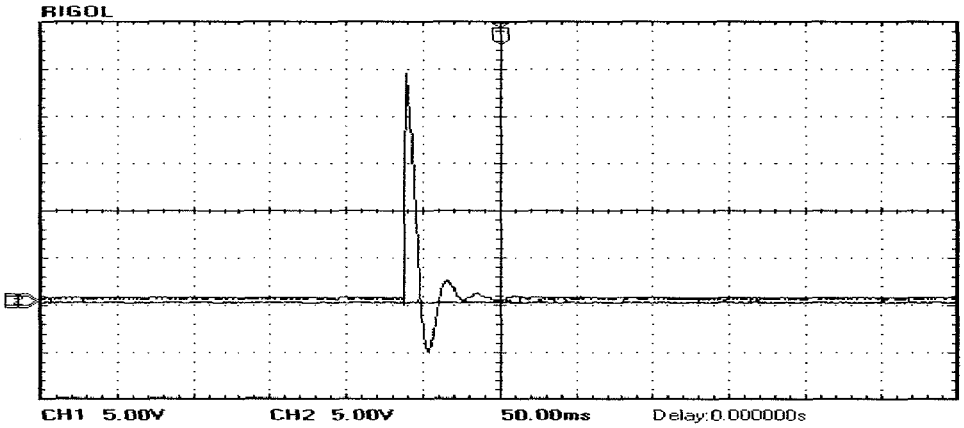
FIG. 7: Voltage oscillograph of Field Coils in Breaking

From the current oscillograph of breaking current shown in FIG. 7, it is seen that the current is also a single-pulse less than 50 ms. The circuit consisted of normally closing point of JK1-2, resistor R6, and diode D4 discharges the capacitor C5.

Relay J1 used in interface circuit improves anti-interference performance of LCDC contactor. The resistor R2 and capacitor C2 connecting in a way of energy-saving makes relay J1 stable for a long time. The relay J1 can be driven by integrated circuit, SCM, PLD, LOGO and PLC. In addition, LCDC contactor can realize the functions of overheat protection, overload protection and time-delaying by interface circuit, which facilitates the plugging extensive module to be electronic.

In the FIG. 5, the service life of LCDC contactor is influenced by both relays J2 and J3. Comparing the electrical life of 100 thousand operations and mechanical life of 10 million operations from the parameter on the relay of this kind, the measured electrical life of the relay is less than 80 thousand operations without any technical protective measures, which is mainly caused by the coil burned in arc in the gap of contacts at the relay breaking. After adopting the technical method of constant current charging circuit, the regular open contact of relay J2 closes, and LC circuit instituted of capacitor C4 and field coil KM can not arc without the sudden change of current. After 80 ms delay of contact breaking, the voltage of storage capacitor C4 is closed to 0 through discharging, which leads to no arc and improves the electrical life of relays J2 and J3 from 100 thousand operations to 2 million operations. So, this invention improves the service life of LCDC contactor.

LCDC contactor in this invention has good performance on controllable movement and every index has a leading position in the world. Take LCDC contactor of 105 A for example, it has service life longer than 1 million operations, operating frequency of 2400 operations per hour, and starting power of 12 W. The application range of LCDC contactor varies from 100 A to 800 A.

The controlling system consisted of LCDC contactor will be explained with actual applications of LCDC contactor.

EXAMPLE 4

Figure 8:
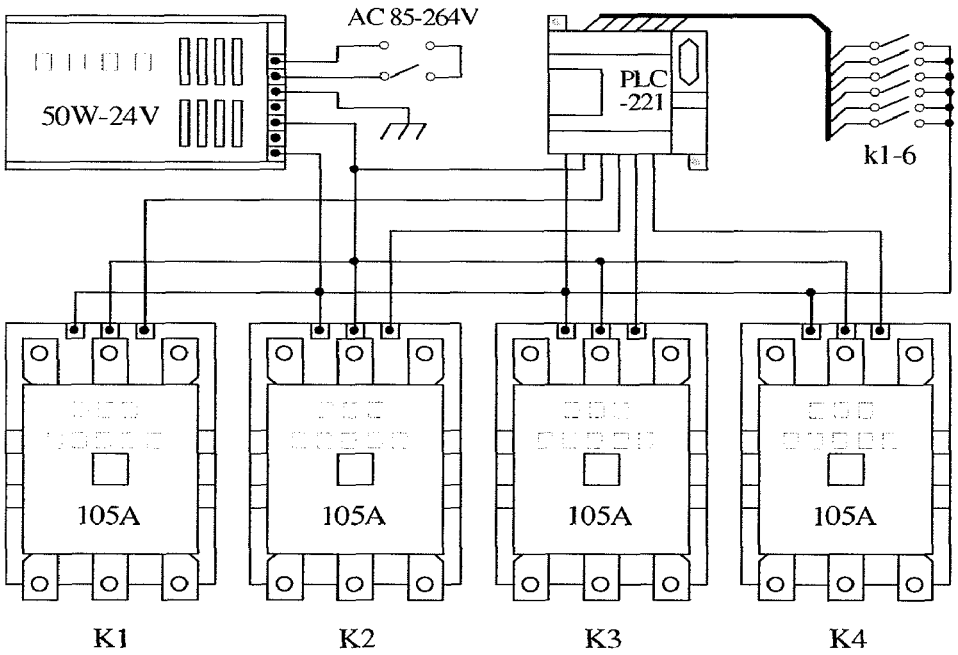
FIG. 8: Control System Structure of Example 4

FIG. 8 is an example of application in connecting LCDC contactor to switching power supply and signal source. The switching power of system in figure is 50 W much less than 1200 W of the currently advanced product in the same kind, which needs PLC connected with middle relay. The output ports Q0, Q1, Q2, Q3 connected with 4 LCDC contactor controlling port C respectively constitute a commercial hardware platform. According to the actual demand, LCDC contactor can adapt the relevant controlling program to ensure the desired goals are met

EXAMPLE 5

Figure 9:
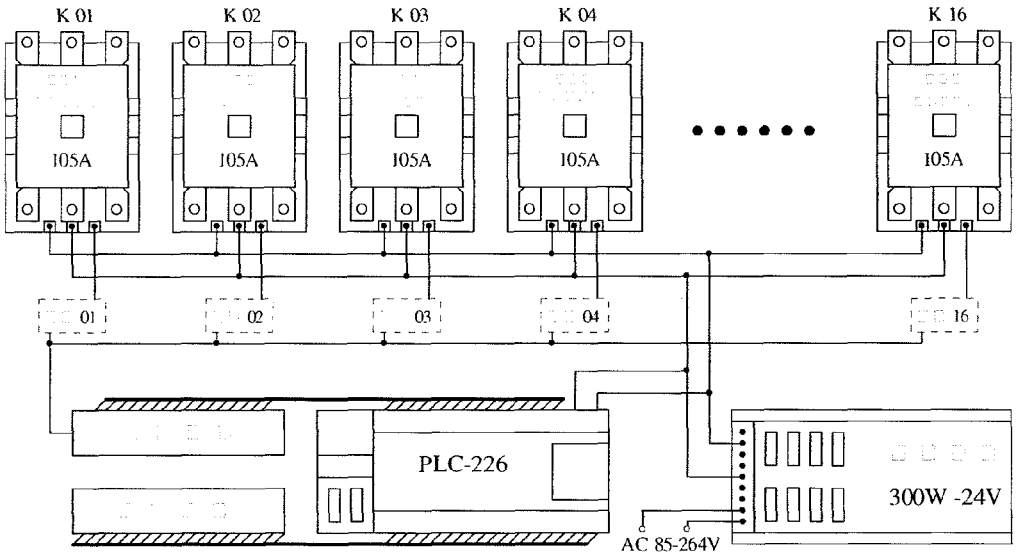
FIG. 9: Control System Structure of Example 5

FIG. 9 is an applicational example of LCDC contactor in industrial field. 16 LCDC contactors in the figure and PLC-226 are connected with 300 W switching power supply, the input ports of K01~K16 inside decoding circuits are connected with output ports of decoding circuits, and the decoding circuits are connected with output ports of PLC. The technical advantage of the application is using only three connecting wires which are allowed to be 200 m at most. Adapting coding, decoding controlling circuit and fieldbus interface simplifies the linking and designing system greatly.

EXAMPLE 6

Figure 10:
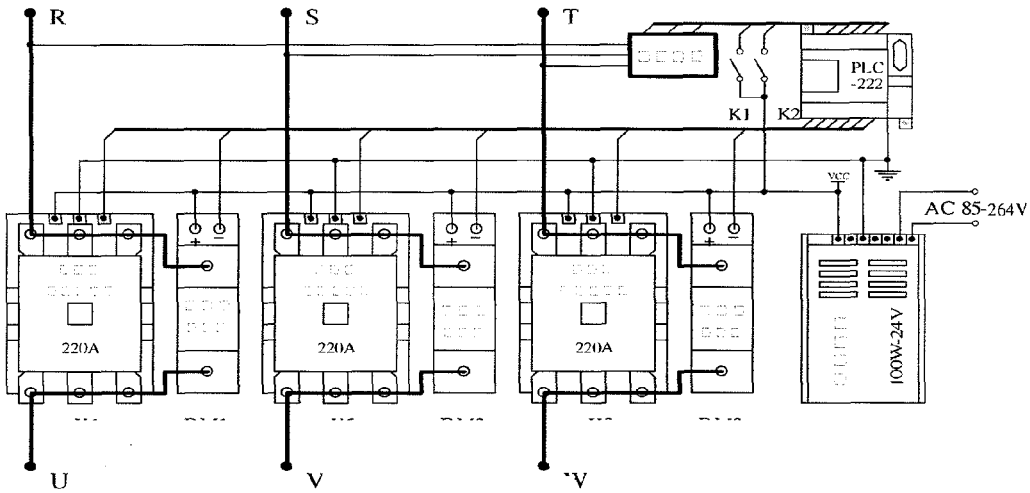
FIG. 10: Power Supply System Structure of Example 6

FIG. 10 is an example of LCDC contactor applicated in synchronized switching low-voltage terminal power supply system. In the figure, LCDC contactor, PLC-222, electronical arc-extinguishing module are connected with the switching power. The controlling ports of LCDC contactor and electronical arc-extinguishing module are linked with outputting ports of PLC-222 respectively. The inputting port of PLC-222 is connected with controlling switch and detecting circuit of synchronized signal which is connected with R, S, T input power. The three poles of contactor are connected in parallel with electronical arc-extinguishing module. One port is connected with the input power R, S, T, and the other is connected with the output power U, V, W.

The technical characteristics are: aiming at avoiding the surge voltage and current as contactor plunges into electrical system, and switches at the most harmful phase angle improves the energy quality of electricity and service life of contactor. This technical solution is not only regarded as traditional arc-extinguishing module but also optimizes the controlling precision of driving circuit from microsecond-level to mill microsecond-level.

The three poles of LCDC contactor used in parallel and arc-extinguishing module are considered as one pole within the independent power controlling system. The synchronized switch of power supplying system is controlled by PLC. The process is as follows: As LCDC contactor picks on, receiving signal from switch K1 and synchronized signal, PLC turns on arc-extinguishing module and LCDC contactor in sequence at the appointed phase angle. The arc-extinguishing module is turned off after all LCDC contactor are turned on. As LCDC contactor breaks, receiving signal from switch K2, PLC turns on arc-extinguishing module and turns off LCDC contactor in sequence at the appointed phase angle. The arc-extinguishing modules are turned off after LCDC contactor breaks. The controllability of LCDC contactor is the base for achieving synchronized switch.

This new LPC CNC is a breakthrough in contactor designing concept and extends the space for contactor's existence and development with brand new ways of thinking.

While the invention has been described in detail and with reference to specific embodiments thereof, it will be apparent to one skilled in the art that various changes and modifications can be made therein without departing from the spirit and scope thereof.

The invention claimed is:

1. A low consumption digital controlled (LCDC) contactor comprising:

an insulated base having a driving mechanism including connecting terminals, a driving circuit, field coils, a movable core and a fixed core, said connecting terminals connected with said driving circuit, said driving circuit connected with said field coils, the fixed core made from laminated silicon-steel sheets;

a permanent magnet laid in the fixed core, the permanent magnet inlaid in the position furthest from the movable core and stable as the LCDC contactor is shocked by external forces; and an external power and an external controlling signal used to control the LCDC contactor, wherein the driving circuit uses single-pulse trigger current to drive the field coils.

2. The LCDC contactor according to claim 1, wherein the fixed core is a U shaped core having two laterals and a flute with the permanent magnet inlaid at the bottom of the flute, said field cores being parallel field cores installed in said U shaped fixed core for low-voltage starting, and both laterals of said U shaped fixed core hold the silicon-steel sheets forming two relatively independent magnetic circuits.

3. A controlling system comprising a power resource, a controller, and at least one LCDC contactor of claim 1, the power resource connected to the LCDC contactor and the controller, the controller linked to the LCDC contactor.

4. The controlling system according to claim 3, wherein the power resource is switch power, the controller is PLC or PLD, and said controller supplies said LCDC contactor a controlling signal source current of at most 15 mA.

5. The LCDC contactor according to claim 1, wherein the fixed core has two flutes and is an E shaped core having two laterals, the permanent magnet being inlaid at the bottom of both flutes, and both laterals of said E shaped fixed core hold the silicon-steel sheets forming two relatively independent magnetic circuits.

6. The LCDC contactor in accordance with claim 1, wherein the permanent magnet is a Nd—Fe—B permanent magnet.

7. A low consumption digital controlled (LCDC) contactor comprising:

an insulated base having a driving mechanism including connecting terminals, a driving circuit, field coils, a movable core and a fixed core, said connecting terminals connected with said driving circuit, said driving circuit connected with said field coils, the fixed core made from laminated silicon-steel sheets;

a permanent magnet laid in the fixed core, the permanent magnet inlaid in the position furthest from the movable core and stable as the LCDC contactor is shocked by external forces; and an external power and an external controlling signal used to control the LCDC contactor, the driving circuit connecting the external controlling signal through 3 terminals which are power port, controlling port and public port, with the power port being connected to the external power, the controlling port being connected to the external controlling signal, and the public port being connected to ground.

8. A low consumption digital controlled (LCDC) contactor comprising:

an insulated base having a driving mechanism including connecting terminals, a driving circuit, field coils, a movable core and a fixed core, said connecting terminals connected with said driving circuit, said driving circuit connected with said field coils, the fixed core made from laminated silicon-steel sheets;

a permanent magnet laid in the fixed core, the permanent magnet inlaid in the position furthest from the movable core and stable as the LCDC contactor is shocked by external forces; and an external power and an external controlling signal used to control the LCDC contactor, wherein the driving circuit includes two relays, a holding storage capacitor, a breaking storage capacitor, a charging circuit and a discharging circuit, said driving circuit switches a current direction of said field coil by said two relays, said charging circuit charges said holding storage capacitor and said breaking storage capacitor, respectively, and said discharging circuit discharges said field coil to form a single-pulse trigger current.

* * * * *